United States Patent [19]

Vairo

[11] Patent Number: 4,565,536

[45] Date of Patent: Jan. 21, 1986

[54] DOLL WITH INGESTION SYSTEM

[76] Inventor: Silvana Vairo, Via Giulini 10, Como, Italy

[21] Appl. No.: 545,626

[22] Filed: Oct. 26, 1983

[51] Int. Cl.[4] ..... A63H 3/24

[52] U.S. Cl. ..... 446/305

[58] Field of Search ..... 446/304, 305, 350, 352, 446/353, 354

[56] References Cited

U.S. PATENT DOCUMENTS

| | | | |
|---|---|---|---|
| 2,945,321 | 7/1960 | Carter | 446/305 |
| 3,383,795 | 5/1968 | Ryan et al. | 446/304 |
| 3,858,352 | 1/1975 | Cummings et al. | 446/305 |

*Primary Examiner*—Mickey Yu

*Attorney, Agent, or Firm*—McAulay, Fields, Fisher, Goldstein & Nissen

[57] ABSTRACT

Doll with limbs subject to motor for its movement, having an esophagus which leads to the mouth in order to introduce objects/food sensitive to the passage of the objects/food, to give a start signal to such motors with at least one sensor organ, electrically connected to the motor, and on such connection is placed an individual timer, to stop the motor after a prefixed time. Apart from movement, the response of the doll to the introduction of objects/food can be equivalent to the movements and/or reactions of a child, obtained by means of the aforesaid sensor organs, using a motor or timer or equivalent, with the purpose of giving an alimentary education, a relation cause of the introduction of the food, which has prefixed values, and the characteristics and metabolism.

5 Claims, 4 Drawing Figures

DOLL WITH INGESTION SYSTEM

BACKGROUND OF THE INVENTION

This new invention is precisely a doll whose limbs are subject to half motors for the movement of the very doll.

For the enjoyment of children, dolls and such like, capable of different movements, completely automatic, have been in use for a long time for example dolls which stand up and walk on their own.

Various successful efforts have been made to give to the movements and in particular to the movement a natural and true to life aspect which makes the toys particularly attractive.

Such dolls, however, even though they are generally satisfying, present, on a closer analysis, an inconvenience from the educative point of view. In fact, the automatic movements give the dolls a mechanical, cold aspect, just like a machine, which starts and stops on command.

This conditions the child and suffocates the natural development of the creativeness and spontaneity, accustoming the child to a passive use of the toy, and hence to a stereotype of attitudes, choices and therefore ideas.

SUMMARY OF THE INVENTION

The new invention serves the purpose of supplying children with a doll which has such structural and functional characteristics as to appear amusing and educative, overcoming the aforesaid inconvenience.

This can be done with a doll of the type specified, which has an esophagus with one end placed at the level of the mouth, for the insertion of objects/food, and at least one sensor organ placed in correspondence with the esophagus, sensitive to the passage of food/objects within, and emit a start signal to the aforesaid half motors.

The advantage is that at least one sensor organ is electrically connected to the motor, and on such connection is placed a distinct timer, which stops the motor after a prefixed time.

Other characteristics and advantages of the doll, will be examined in the following description relating its best function, made for a revealing purpose and not for a limitating one, with reference to the attached tables.

DESCRIPTION OF THE PREFERRED EMBODIMENT(S) OF THE INVENTION

Figure 1:
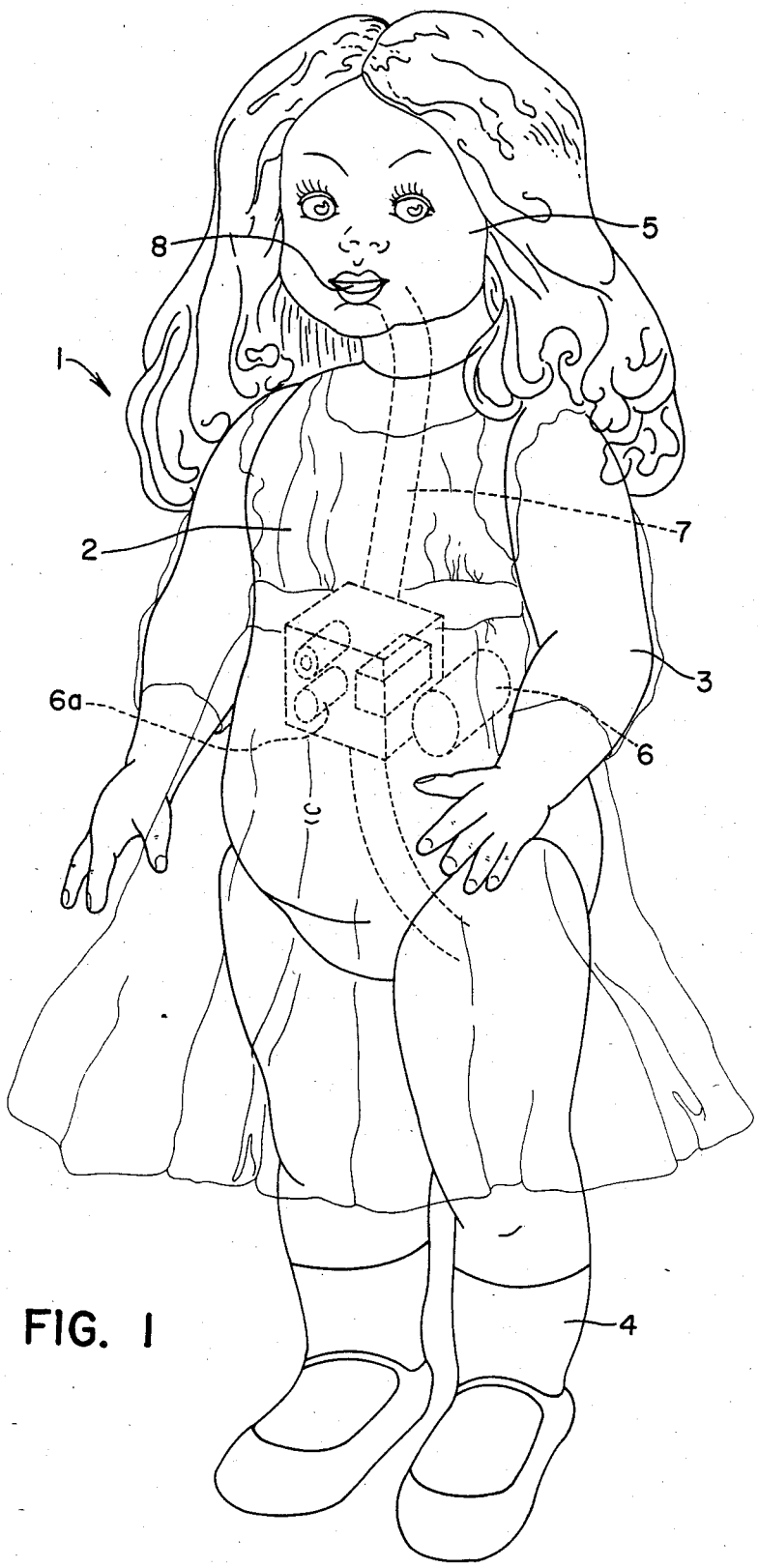
FIG. 1 represents a side view, partially transparent, of the new doll.

With reference to the attached pictures, the embodiment of the invention is globally represented in FIG. 1.

Doll 1, reproducing the features of a little girl, has a body 2, with articulating superior limbs 3, inferior limbs 4, and a head 5. The inferior limbs 4 are subject, in a totally conventional way, to the movement of the motor 6, placed in the body 2, for the automatic deambulation of the doll 1. The advantage is that the motor 6 comprises an electric motor, which is alimented by a battery

Figure 2:
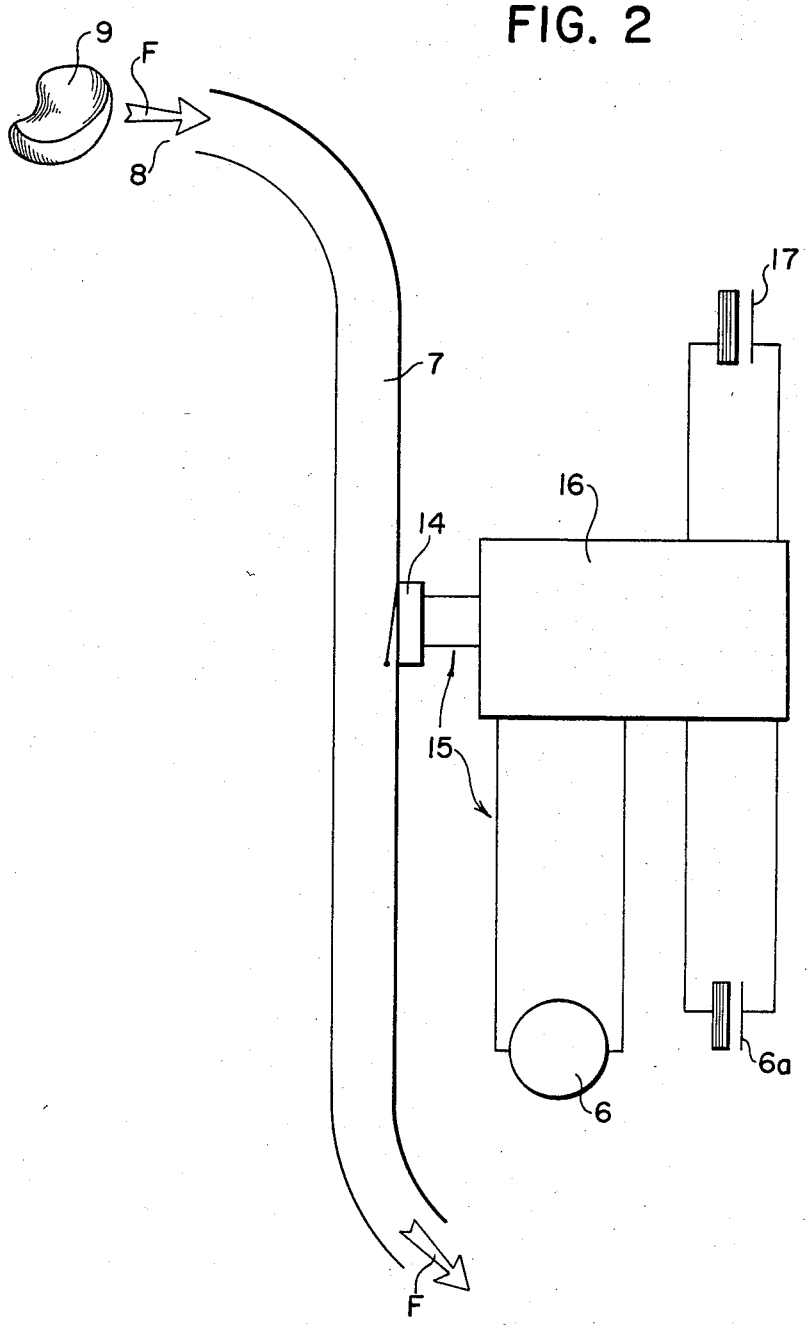
FIG. 2 represents a schematic view of a close-up of the doll in FIG. 1.

6*a*. The doll is provided with a tube 6*t*, functioning as an esophagus 7, one extreme of which leads to an opening, which is the mouth 8. Numbers 9, 10, 11, 12 and 13 in the pictures represent different food/objects, of dimensions which can be inserted in the mouth 8. The arrows F indicate the method of insertion and the direction of the food/objects respectively in the mouth 8 and through the esophagus 7. With reference to FIG. 2, number 14 indicates a sensor organ, advantageously being a microcontact, which is placed in correspondence with the esophagus 7 and is sensitive to the passage within it of any object/food 9.

The microcontact 14 is connected by a wire 15 to the electric motor. A timer 16 is placed on the wire 15 and calibrated according to a prefixed $T_1$ time phase.

17 indicates a battery for the powering of the timer 16.

As the object/food 9 passes along the esophagus 7, the microcontact 14 vibrates, and emits a start signal to the electric motor 6, determined at the beginning of the movement of the doll 1.

At the same time this signal starts off the timer 16. The latter, once the $T_1$ time phase is over serves the purpose of stopping the motor, signaling in this way the end of the movement.

Figure 3:
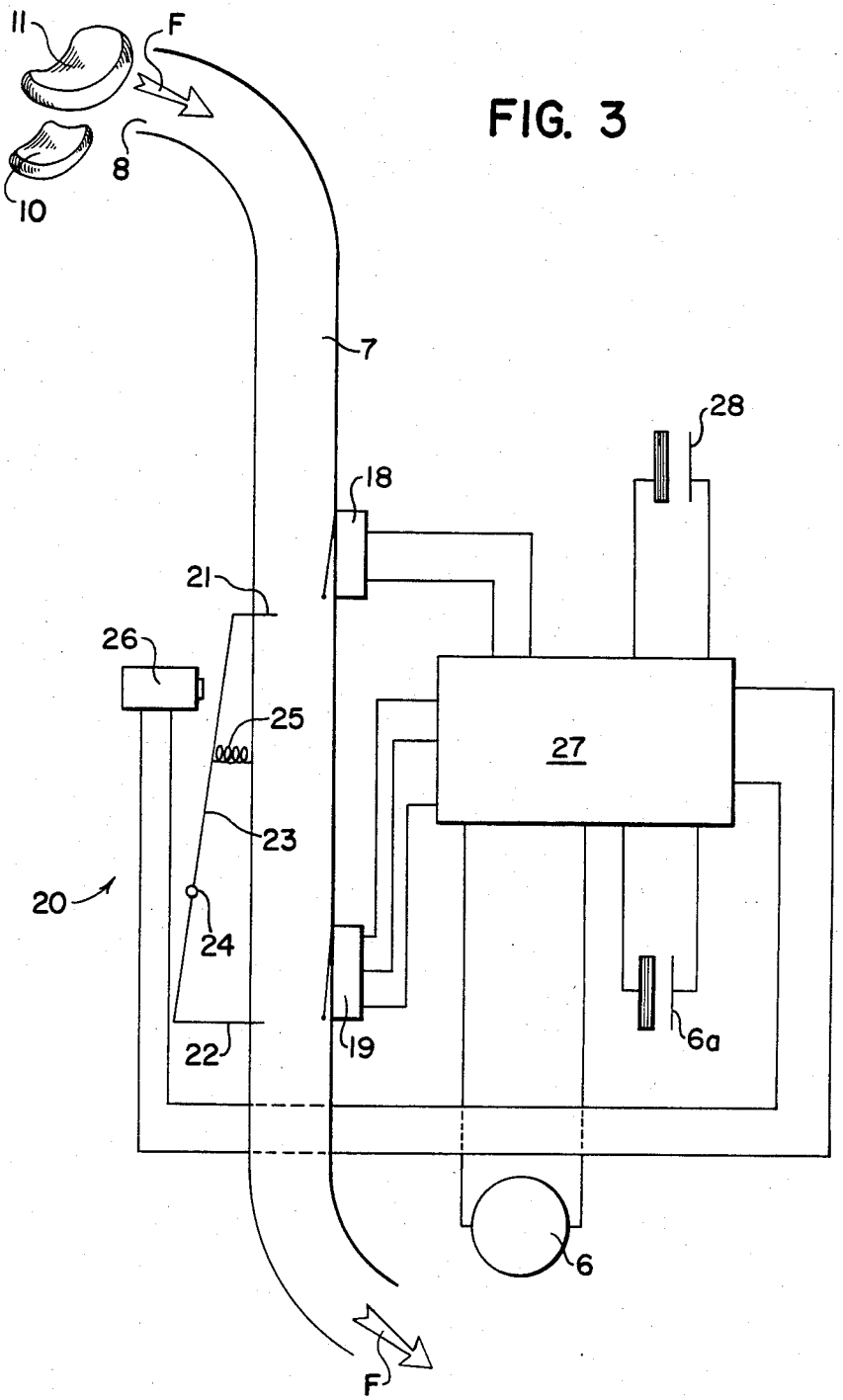
FIG. 3 represents a schematic view of another close-up of FIG. 1.

With reference to FIG. 3, there follows another example of a new creation; the elements are exactly the same as those in FIG. 2, indicated with the same reference numbers and they are not described in depth so as not to lengthen the summary.

According to this example, along the esophagus 7 there is one sensor organ 18, and another sensor organ 19 placed below the other, and both are supplied with a microcontact.

20 globally indicates a mechanism which includes two small bars 21 and 22, which move in turn through the esophagus, in correspondence with the microcontacts 18 and 19 respectively, and immediately below them.

Above all, the small bars 21 and 22 are connected to the counterposed extremity of a lever 23, attached at an intermediate point to a pivot 24 fixed to the body 2 of the doll; the lever 23 is fixed by a spring 25 in a first position, in which the small bar 21 is inserted through the esophagus, and the small bar 22 is in a disconnected position; 26 indicates another electromagnet, not sensitive, on the lever 23, against the contrast of the spring 25, to move it in a second position, in which the small bar 21 is in a disconnected position, and the small bar 22 in a connected position.

The small bar 21, when it is in its inserted position, does not allow the passage of both object/food 10 of small dimensions, and of object/food 11 of big dimensions, and the microcontact holds it back, and consequently excites the latter.

The small bar 22, when it is in an inserted position, allows the free passage of object/food 10 along the esophagus 7, while it stops the passage of the object/food 11 of big dimensions, and consequently excites the latter.

The small bars 21 and 22, when they are in their disconnected position, allow the passage of both small and big objects/food.

27 indicates the two pace timers, calibrated to two prefixed times $T_1$ and $T_2$.

$T_2$ being greater than $T_1$, charged with a distinct battery 28 and attached to the microcontacts 18 and 19, to the motor 6 and the electromagnet 26. When an object/food 10, or 11, is inserted in the mouth 8 and with the force of gravity falls along the esophagus 7, it is stopped by a small bar 21 and excited by a microcontact 18.

This causes the start of the motor 6 and therefor the movement of the doll 1. This also causes the start of the timer of the $T_1$ time phase and the excitment of the electromagnetic 26.

Because of this, the small bar 21 goes from the insertion position to the disconnection, leaving the object/food to fall, while at the same time the small bar 22 goes from the disconnetion position to that of insertion.

As aforesaid, with the small bar 22 in such a position, the object/food 10 of small dimensions continues to fall, passing by the microcontact 19 without exciting it, whereas in the mean time the object/foor 11 of big dimensions is held back by the microcontact 19, and determining its excitement.

In this way the microcontact 19 is selectively sensitive to the prefixed values of the characteristics of the object/food, and particularly to its dimensions.

If the microcontact 19 is excited, it causes the start of the timer 27, relative to its time pace $T_2$ and together they provoke the opposite phenomenon, and they deactivate the electromagnet 26, and thus they permit the return to the mechanism 20 in its initial position, and the definitive drop of the object/food 11 from the esophagus.

The stop of the motors 6 and therefor the end of the movement of the doll are selectively provoked by the timer 27 when the time phase $T_1$, or in other words the time phase $T_2$, according to which microcontact 18, or even 19, was excited, and therefor depending on the big or small dimensions of the object/food inserted in the mouth of the doll.

Figure 4:
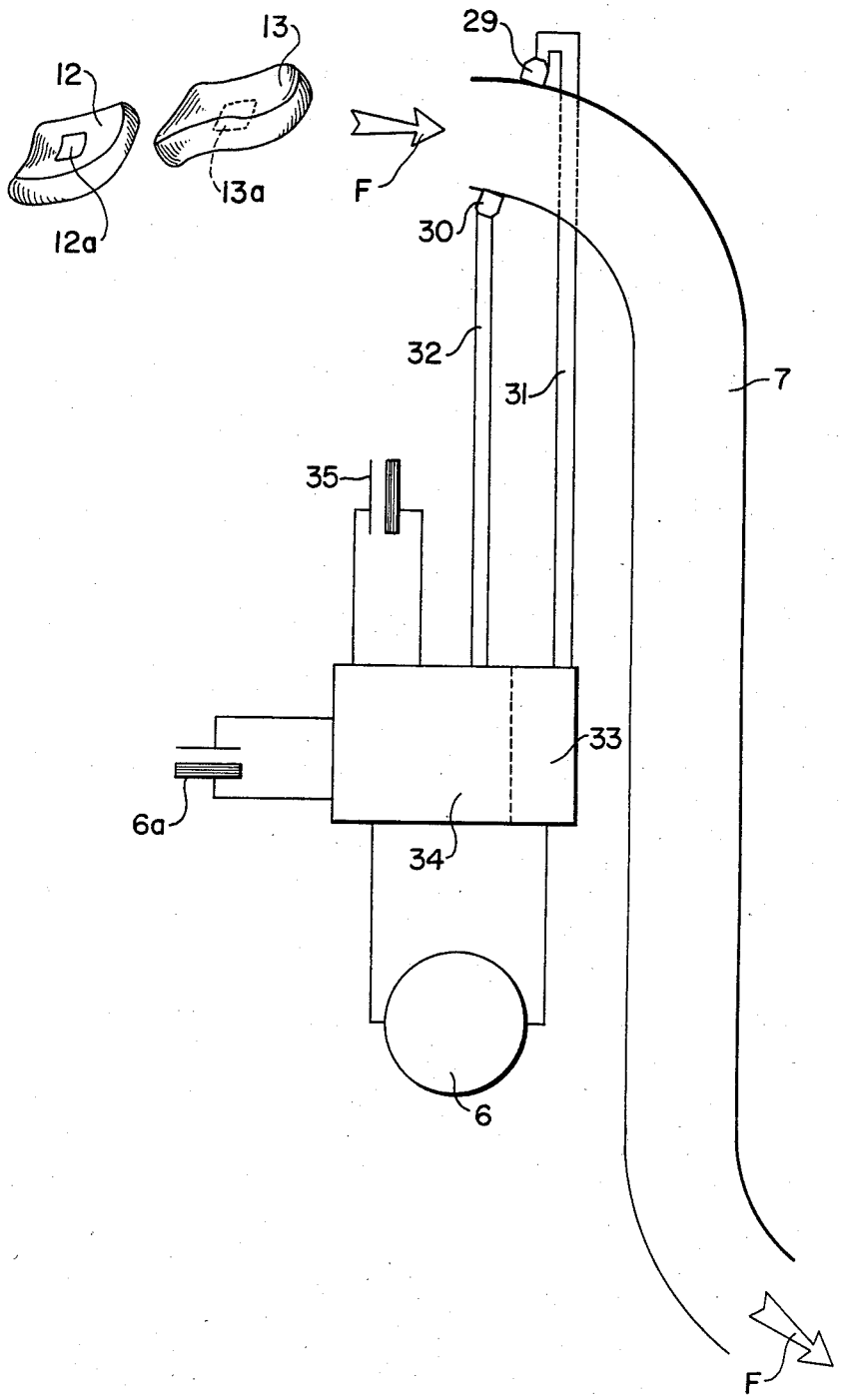
FIG. 4 represents once more a schematic view of another close-up of FIG. 1.

With reference to FIG. 4 we can describe another example of an invention; the elements of this sample are exactly the same to those of the preceding, and they are indicated with the same reference numbers and are not described in detail so as not to lengthen the report. 29 and 30 indicate two sensor organs, and advantageously two magnetic forces, placed along the esophagus 7 and in correspondence with the mouth 8, on the walls in front of it.

The magnets 29 and 30 are connected to the electric motor by distinct wires.

33 and 34 indicate two timers, calibrated according to two phases $T_1$ and $T_2$ placed on the wires 31 and 32 respectively, and fed by a battery 35. The magnetic forces 29 and 30 are both sensitive to the values of a specific characteristic of the object/food 12 and 13. Above all, the object/food 12 and 13 both incorporate an individual magnet **12*a* and 13*a***, and the latters are placed opposite to the object/food.

The objects/food 12 and 13, are shaped according to the opening at the mouth 8. Above all they are curved to match the curved shape of the mouth, which is smiling. In this way the object/food can be inserted in the mouth as there is an imposed orientation.

The objects/food 12 and 13 incorporate the magnets **12*a* and 13*a* in such a position as to find themselves in correspondence with the magnetic forces 29 and 30** during the act of the insertion of the object/food in the mouth, according to the aforesaid imposed orientation.

During the insertion of the object/food 12 or 13, the magnetic wave 29 or 30 interested by the magnet **12*a* or 13*b*, starts off the motor 6, determining the commencement of the movement of the doll. Once the $T_1$ and $T_2$ time phase is over, the 33 or 34** timer stops the motor, determining the end of the deambulation.

With the embodiment of the invention, the functioning is made to reproduce the correlation existing between the taking in of food and the development of movements.

The principal advantage of the creation lies in the fact that it is amusing as well as enthusiastically educational at the same time; in fact, the functioning of the doll explains the relationship between cause and result, which is expressed by the natural process between food and movement. This relationship between food and movement is enriched even more by the fact that the child has the possiblity to decide its duration, operating on the choice of the quantity.

Another advantage of the creation is that it has the function of an educational instrument and to introduce children to the concept of a correct nutrition and above all, to the relationship between the consumption of food and its development into energy.

Furthermore, the presence of the timer in this creation, stops the movement and thus overcomes the inconvenient which is frequent in similar toys, which is the running out of batteries, should they be inadvertedly left on.

It is obvious that, even though specific references have been made to a doll having the characteristics of a little girl, the creation can also be applied to dolls of different aspects altogether, for example monkeys, bears, ducks, or other toys in general, either deambulating or which can move.

It is also obvious that the dolls described can be taken to electricians, to satisfy contingent requirements, numerous modifications, all included within the area of protection of the creation, as defined in the claims listed on the following page.

What I claim is:

1. A doll having limbs and a motor for the movement thereof, comprising:

an esophagus having one end connected with a mouth of the doll for the insertion of objects simulating food into said one end of said esophagus;

a first sensor organ connected to said esophagus sensitive to the passage therewithin of said objects;

a second sensor organ connected to said esophagus spaced from and below said first sensor organ, said second sensor organ being selectively sensitive to prefixed values of determined characteristics of said objects; and a two-phase timer operatively connected with each of said first sensor organ and said second sensor organ selectively sensitive to prefixed values of determined characteristics of said object to stop said motor selectively after a first prefixed time phase and a second prefixed time phase, each related to the size of said object.

2. The doll of claim 1, wherein said first sensor organ includes a microcontact to send a starting signal for the starting thereof.

3. The doll of claim 2, including a pair of spaced bars associated with said esophagus for determining the size of said object passing therethrough.

4. A doll having limbs and a motor for the movement thereof, comprising:

an esophagus with one extreme end thereof at the level of a mouth of said doll;

two sensor organs connected with said esophagus and each being selectively sensitive to respective values of a defined characteristic of an object/food; and timing means associated with each said sensor organs and said motor;

said sensor organs being operatively responsive to the presence of a particular object/food in said esophagus for starting of said motor; and a timer associated with each said sensor organ to stop said motor in accordance with a prefixed time phase associated with each said sensor organ.

5. The doll of claim 4, wherein said sensor organs include magnetic means responsive to said objects.

* * * * *